US011919082B2

(12) United States Patent
Fuesting et al.

(10) Patent No.: US 11,919,082 B2
(45) Date of Patent: Mar. 5, 2024

(54) METHOD FOR MAKING TURBINE ENGINE COMPONENTS USING METAL INJECTION MOLDING

(71) Applicant: Rolls-Royce Corporation, Indianapolis, IN (US)

(72) Inventors: Timothy Paul Fuesting, Indianapolis, IN (US); Logan Kroneman, Indianapolis, IN (US)

(73) Assignee: Rolls-Royce Corporation, Indianapolis, IN (US)

( * ) Notice: Subject to any disclaimer, the term of this patent is extended or adjusted under 35 U.S.C. 154(b) by 0 days.

(21) Appl. No.: 17/513,743

(22) Filed: Oct. 28, 2021

(65) Prior Publication Data

US 2023/0140657 A1 May 4, 2023

(51) Int. Cl.

| | |
|---|---|
| ***B22F 3/10*** | (2006.01) |
| ***B22F 3/22*** | (2006.01) |
| *B22F 3/24* | (2006.01) |
| *B22F 5/00* | (2006.01) |
| *B22F 5/04* | (2006.01) |

(52) U.S. Cl.

CPC ..... *B22F 3/225* (2013.01); *B22F 3/10* (2013.01); *B22F 2003/247* (2013.01); *B22F 5/009* (2013.01); *B22F 5/04* (2013.01); *B22F 2998/10* (2013.01)

(58) Field of Classification Search

CPC .. B22F 3/225; B22F 3/10; B22F 5/009; B22F 5/04; B22F 2003/247; B22F 2998/10

See application file for complete search history.

(56) References Cited

U.S. PATENT DOCUMENTS

| | | | | |
|---|---|---|---|---|
| 5,248,552 | A * | 9/1993 | Moore | B29C 33/52 164/369 |
| 5,972,269 | A | 10/1999 | Barros et al. | |
| 6,274,083 | B1 | 8/2001 | Clark, III | |
| 6,547,210 | B1 * | 4/2003 | Marx | B28B 1/24 249/63 |
| 7,662,338 | B2 * | 2/2010 | Tanaka | C04B 35/638 419/36 |
| 9,028,744 | B2 | 5/2015 | Durocher et al. | |

(Continued)

FOREIGN PATENT DOCUMENTS

| | | |
|---|---|---|
| EP | 1930099 A1 | 6/2008 |
| JP | 0813005 A | 1/1996 |

OTHER PUBLICATIONS

Sparkman et al., "Making Metal Injection Molding Faster," designworldonline.com, Aug. 11, 2014, 5 pp.

*Primary Examiner* — Nicholas A Wang
*Assistant Examiner* — Maxwell Xavier Duffy
(74) *Attorney, Agent, or Firm* — Shumaker & Sieffert, P.A.

(57) ABSTRACT

A method for manufacturing a turbine shroud segment with at least one undercut region. The method includes forming a removable insert including an external surface corresponding to at least a portion of a wall of the undercut region in the turbine shroud segment; placing the removable insert in a mold including a mold cavity corresponding to a shape of the turbine shroud segment; injecting a metal injection molding (MIM) feedstock into the mold cavity and around the removable insert to form a shroud green body with the at least one undercut region; and, sintering the shroud green body to form the shroud body.

18 Claims, 5 Drawing Sheets

(56) References Cited

U.S. PATENT DOCUMENTS

| | | | | |
|---|---|---|---|---|
| 9,950,370 | B2 | 4/2018 | Roth-Fagaraseanu et al. | |
| 2003/0138339 | A1* | 7/2003 | Scancarello | C22C 33/0228 418/55.2 |
| 2008/0124239 | A1* | 5/2008 | Xu | G11B 33/121 |
| 2013/0052074 | A1* | 2/2013 | Durocher | F01D 9/04 419/5 |
| 2013/0156626 | A1 | 6/2013 | Roth-Fagaraseanu et al. | |

* cited by examiner

METHOD FOR MAKING TURBINE ENGINE COMPONENTS USING METAL INJECTION MOLDING

BACKGROUND

Metal casting involves pouring molten metal or alloy into a mold, and allowing the poured molten material to cool and solidify into a part shaped by the mold. The part may be retrieved from the mold, for example, by breaking or disassembling the mold. Turbine engine parts such as, for example, turbine shroud segments, have complex shapes and can be manufactured using traditional manufacturing methods such as sand casting, forging, and the like.

In a metal injection molding (MIM) process, a metal powder feedstock is injected into a mold to form a part, and, as in traditional casting methods, the mold is disassembled to retrieve the molded part. MIM has been used to create some turbine engine parts having relatively simple geometries with near-net shape at high volumes. By reducing the investment in forging and casting processing steps such as investment mold building, post processing, and the like, and requiring only minimal machining, and in some cases MIM can significantly reduce costs compared to traditional manufacturing methods.

Mold design for MIM requires that the mold be openable after injection without causing damage to the molded part. Making turbine engine parts with undercut regions, which include overhangs and complex curvatures, with MIM can result in die lock, where the mold used in the MIM process is difficult or impossible to open after feedstock injection without causing damage to the molded part released from the mold. As a result, current MIM design practice limits geometries to simple components, and makes more complex parts with undercut regions difficult to mold without damaging the part or requiring undesirable additional machining steps. In some cases, to make parts with undercut regions, mold designs require creating multiple slides that come together to create the complex shapes of the undercuts and overhangs adjacent to the undercuts, but such design requirements add costs to the tooling and injection process, and reduce the desirability of MIM.

SUMMARY

To address problems with die lock and allow more complex turbine engine part geometries to be made using metal injection molding (MIM), molding techniques are needed to allow the mold to be opened after injection without causing an undesirable amount of damage to complex features of the molded part. In general, the present disclosure is directed to an insert placed in a mold for use in a metal injection molding (MIM) process to form a turbine engine part with a complex feature such as, for example, an undercut region. During the MIM process, the insert is placed in the mold such that the feedstock injected into the mold forms the undercut region about at least a portion of an exterior surface of the insert. The insert shapes and supports the undercut and any overhangs adjacent to the undercut during the injection process, and maintains the shape of the undercut region during mold removal and in post-molding processing steps. Positioning the insert in the mold can solve complex issues with die lock and allow the mold to be opened after injection without causing undue damage to the turbine engine part or requiring additional machining steps.

In various examples, suitable inserts include removable cores, telescoping or collapsible tools in selected cavities of the mold, and the like.

In one aspect, the present disclosure is directed to a method for manufacturing a turbine shroud segment with at least one undercut region. The method includes forming a removable insert including an external surface corresponding to at least a portion of a wall of the undercut region in the turbine shroud segment; placing the removable insert in a mold including a mold cavity corresponding to a shape of the turbine shroud segment; injecting a metal injection molding (MIM) feedstock into the mold cavity and around the removable insert to form a shroud green body with the at least one undercut region; and sintering the shroud green body to form the shroud body.

In another aspect, the present disclosure is directed to a method for manufacturing a turbine shroud segment with an undercut region including an overhang and at least one arcuate wall portion. The method includes: providing a mold with a mold cavity corresponding to a shape of the turbine shroud segment, wherein the mold cavity includes an adjustable tool with an external surface corresponding to a shape of the at least one arcuate wall portion in the undercut region; adjusting the telescoping tool to provide a desired configuration of the arcuate wall portion; injecting with a metal injection molding (MIM) process a metal powder mixture into the mold cavity and around the adjustable tool to form a shroud green body having the undercut region; and sintering the shroud green body to form the shroud body.

In another aspect, the present disclosure is directed to a method for manufacturing a turbine shroud body with at least one undercut region with an overhang and an arcuate wall beneath the overhang. The method includes forming a sacrificial insert including a body of a soluble material chosen from polymers, waxes, and metal alloys, wherein the body of the sacrificial insert has an external surface corresponding to at least a portion of a wall of the undercut region; placing the sacrificial insert in a mold including a mold cavity corresponding to a shape of the turbine shroud segment; injecting with a metal injection molding (MIM) process a base metal powder mixture into the mold cavity and around the sacrificial insert to form a shroud green body with the undercut region; and sintering the shroud green body to form the shroud body and at least partially dissolve the sacrificial insert.

The details of one or more embodiments of the invention are set forth in the accompanying drawings and the description below. Other features, objects, and advantages of the invention will be apparent from the description and drawings, and from the claims.

BRIEF DESCRIPTION OF DRAWINGS

Like symbols in the drawings indicate like elements.

DETAILED DESCRIPTION

Figure 1A:
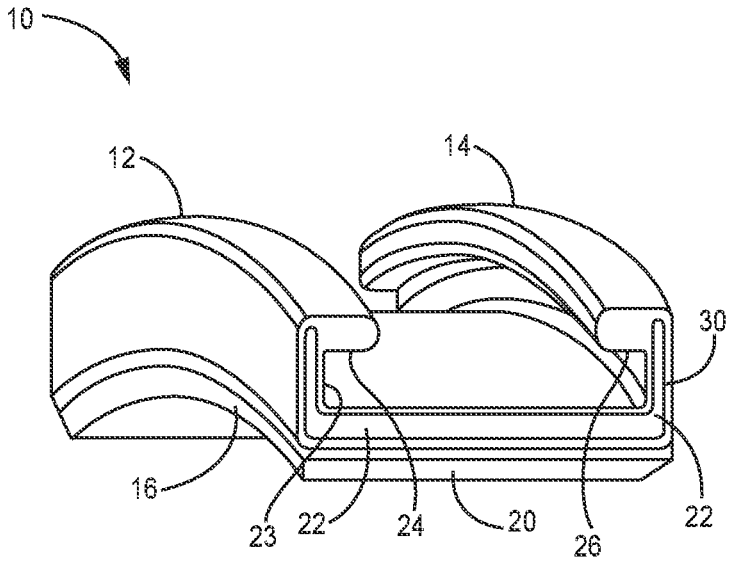
FIG. 1A is a plan view of an example of a metal injection molded (MIM) turbine shroud segment.
Figure 1B:
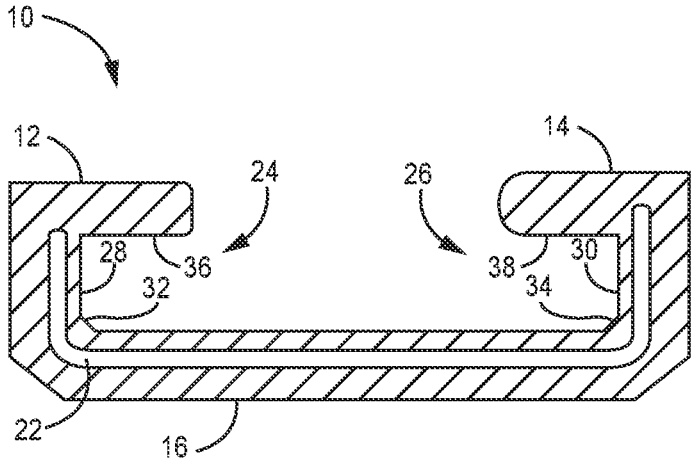
FIG. 1B is schematic, cross-sectional view of the turbine shroud segment of FIG. 1A.

Referring to FIGS. 1A-1B, an example of a turbine engine component that can be made by the MIM processes described herein, in this case a turbine shroud segment 10, includes axially spaced-apart forward and aft hooks 12 and 14 extending radially outwardly from an arcuate platform 16. The platform 16 has an opposite radially inner hot gas flow surface 20 adapted to be disposed adjacent to the tip of the turbine blades. Internal cooling passages 22 are defined in the platform 16. The internal cooling scheme shown in FIG. 1 is for illustration purposes only, and the shape and dimensions of the shroud segment 10 can vary widely depending on the intended turbine engine application.

The turbine shroud segment 10 further includes a first undercut region 24 and a second undercut region 26. The undercut regions 24, 26 each include a respective wall 28, 30, each which may include at least a portion 32, 34 with an arcuate shape. The undercut regions 24, 26 further include respective adjacent overhangs 36, 38, which protrude in a direction generally normal to the respective undercut walls 28, 30.

In other examples, suitable turbine engine components that can be made using MIM processes of the present disclosure can include turbine blades, compressor vanes, low pressure (LP) turbine blade tracks, compressor blade tracks, and the like.

Figure 2:
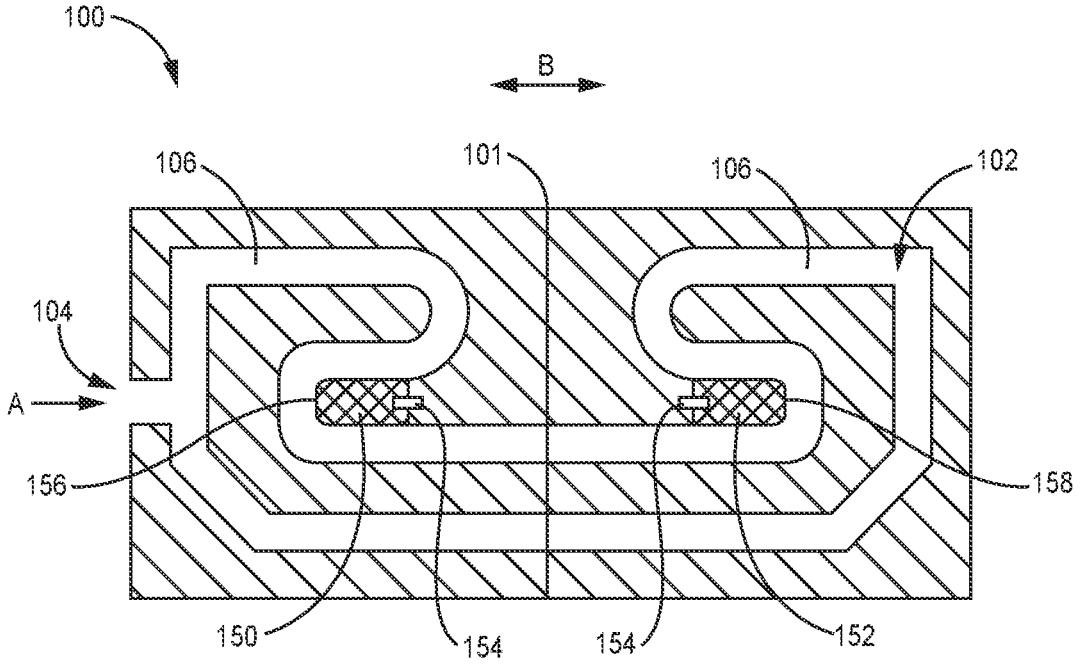
FIG. 2 is a schematic cross-sectional view of a mold suitable for making the turbine shroud segment of FIGS. 1A-1B using a metal injection molding (MIM) process, and including removable mold inserts.

As noted above, the turbine shroud segment 10 may be formed in a mold by a metal injection molding (MIM) process. Referring now to the schematic depiction in FIG. 2, a MIM mold 100 includes a mold cavity 102 corresponding to the shape of the turbine shroud segment 10 of FIGS. 1A-1B (cooling passages not shown in FIG. 2 for clarity), and is shaped to form the undercut regions 24, 26 with walls 28, 30 and overhangs 36, 38. The mold cavity 102 typically is slightly larger than that of the desired finished part to account for the shrinkage that occurs during subsequent processing steps such as, for example, de-binding and sintering.

However, in some cases the walls 28, 30 and the overhangs 36, 38 in the undercut regions 24, 26 may be difficult to reproducibly form with MIM, and may be damaged as the green part is removed from the mold following the molding process and prior to sintering the part. The fragility of the walls 28, 30 and the overhangs 36, 38 make the mold 100 difficult to separate at a separation line 101 following the completion of the MIM process, and the resultant die lock can make MIM molding of complex parts difficult, or even impossible.

The present disclosure is directed to a method for molding a part with MIM in which at least one removable insert 150, 152 is positioned in the mold cavity 102 within the undercut regions 24, 26 to support the overhangs 36, 38 and form the walls 28, 30 during molding and sintering of a green part, as well as during subsequent separation of the mold 100 from the MIM molded part. In some examples, optional fasteners 154 such as pins, screws, adhesives and the like, may be used to support or removably attach the inserts 150, 152 in the mold cavity 102.

In some examples, the removable inserts 150, 152 include a solid body or a hollow body having an exterior surface 156, 158. The exterior surfaces 156, 158 are shaped such that the MIM feedstock entering the mold cavity 102 collects about the removable inserts 150, 152 to form the walls 28, 30 of the finished part 10 (FIGS. 1A-1B) and to prevent the sagging or unwanted collapse of the overhangs 36, 38. In some examples, the inserts 150, 152 may include an optional performance coating layer (not shown in FIG. 2) such as, for example, a layer of a lubricant or a mold release composition, to ease insertion or removal of the inserts from the mold cavity 102. In some examples, the body of the removable inserts 150, 152 may be formed from a first material, and a coating layer on the exterior of the body may include a second material different from the first material to provide, for example, increased resistance to abrasion, increased lubricity to assist flow of the MIM feedstock about the insert, and the like.

In some examples, the removable inserts 150, 152 are formed from a material having a melting temperature sufficient to remain chemically and physically stable at temperatures corresponding to the injection temperatures of the MIM feedstock material. In addition, the removably inserts 150, 152 should be readily removable from the mold cavity 102 prior to, during, or after the consolidation heat treatment cycle of the MIM part, which is referred to herein as sintering.

For example, in some embodiments the removable inserts 150, 152 can be made of a polymeric material that can be dissolved using an acid or base solution, an aqueous solution, water, an organic solvent, or combinations thereof, following molding but prior to the sintering process. In some examples, the inserts 150, 152 can be made of a material that dissolves and vaporizes when heat is applied to the mold 100 prior to or during the sintering process such as, for example, a polymeric material, a wax, or a low melting point metal such as a tin/bismuth based alloy.

In another embodiment, the removable inserts 150, 152 include a ceramic material. In some cases, the inserts 150, 152 are pre-sintered ceramic bodies placed in the mold cavity 102, and may be removed following molding and prior to or after subsequent sintering steps.

After the inserts 150, 152 are properly positioned in the mold cavity 102 to form the undercut regions 24, 26, the walls 28, 30 and the overhangs 36, 38 of the desired part to formed using MIM (FIGS. 1A-1B), the assembly of the mold 100 is completed and the mold cavity 102 is filled be injecting a base metal powder mixture, otherwise known as a MIM feedstock through the port 104 in the direction of the arrow A.

The MIM feedstock generally includes a binder and a metal powder. A variety of binders may be used in the MIM feedstock including, but not limited to, waxes, polyolefins such as polyethylenes and polypropylenes, polystyrenes, polyvinyl chloride, polyacrylics, cyanoacrylates, polytetrafluoroethylene (PTFE) and other fluoropolymers, and mixtures and combinations thereof. The metal powder used in the MIM feedstock can be selected among a wide variety of metal powders, including, but not limited to, Ni, Ti, Cu, Al, steel, alloys thereof, and combinations thereof. A suitable mixture will provide sufficient fluidity to carry the feedstock from an injection port 104 through passages 106 to flow around the removable inserts 150, 152 and fill substantially all of the mold cavity 102.

Once the MIM feedstock is injected into the mold 100, it is allowed to solidify in the passages 106 of the mold cavity 102 to form a green compact part around the inserts 150, 152. After the green compact part has cooled and solidified, the mold 100 is disassembled in the direction of the arrow B about the separation line 101, and in some examples the green shroud segment with its embedded inserts 150, 152 can be removed from the mold 100. In other examples, the green shroud segment and the removable inserts 150, 152 may remain in the mold cavity 102 following molding and during the sintering process. The term "green" is used herein to refer to the state of a formed body made of sinterable powder or particulate material that has not yet been heat treated to the sintered state.

Conditioning operations, including de-binding and sintering, are then performed on this green shroud segment to remove the binder material and to consolidate the molded metal shroud segment into a dense metal part having mechanical properties similar to the material in casted or wrought form. In some examples, at least some of the conditioning operation (e.g. sintering) are performed at high temperatures which are well beyond the melting point of the inserts 150, 152, which can concurrently dissolve or vaporize the inserts 150, 152 during the heat treatment cycle of the MIM shroud segment without requiring any extra manufacturing operations. The use of a low melting point material insert 150, 152 such as a polymer, wax, or low melting point metal alloy in combination with a MIM process can in some cases eliminate the need for a separate insert removal operation. The melting temperature of most polymeric materials are well below the sintering temperatures of metal powders, and plastic inserts and the like may be completely dissolved/vaporized without performing any dedicated insert removal operations. The sintering temperature of various metal powders is well-known in the art and can be easily determined by an artisan familiar with powder metallurgy.

Next, the resulting sintered shroud segment body may be subjected to any appropriate metal conditioning or finishing treatments, such as grinding and/or coating to obtain the final product shown in FIGS. 1A-1B.

Figure 3:
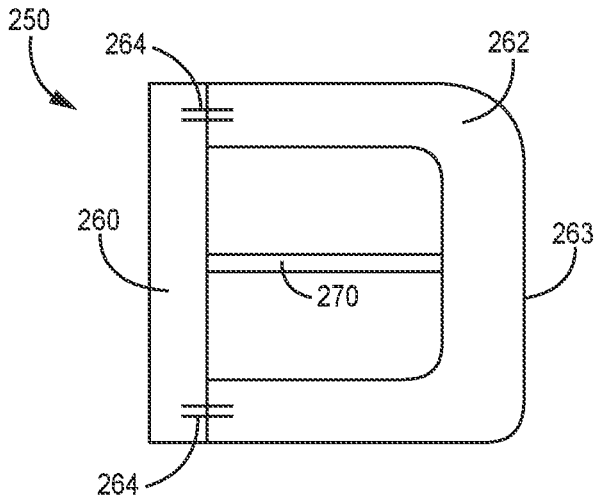
FIG. 3 is a schematic cross-sectional view of an embodiment of a mechanical mold insert suitable for use with the mold of FIG. 2 in a MIM process.

In another embodiment shown schematically in FIG. 3, a removable insert 250 is formed from a mechanical assembly including a first arm 260 for attachment of the insert 250 to the mold, and a second arm 262 including an external surface 263 shaped to form the undercut regions of a part and support an overhang in the undercut regions. In some embodiments, the first arm 260 and the second arm 262 may be joined with fasteners 264, or may be joined by a threaded rod 270 such that the insert 250 is adjustable for use in forming undercut regions of various shapes and sizes. In some examples (not shown in FIG. 3), the second arm 262 may be formed from a plurality of telescoping segments to provide additional adjustability.

In another example, the removable insert 250 can be a pneumatic or hydraulic device that can expand a cylinder to engage a segment or a bladder formed in a suitable shape. In another example, the mechanical assembly could be active through a gear, sprocket or lever such as, a toggle a clamp or a press.

Figure 4:
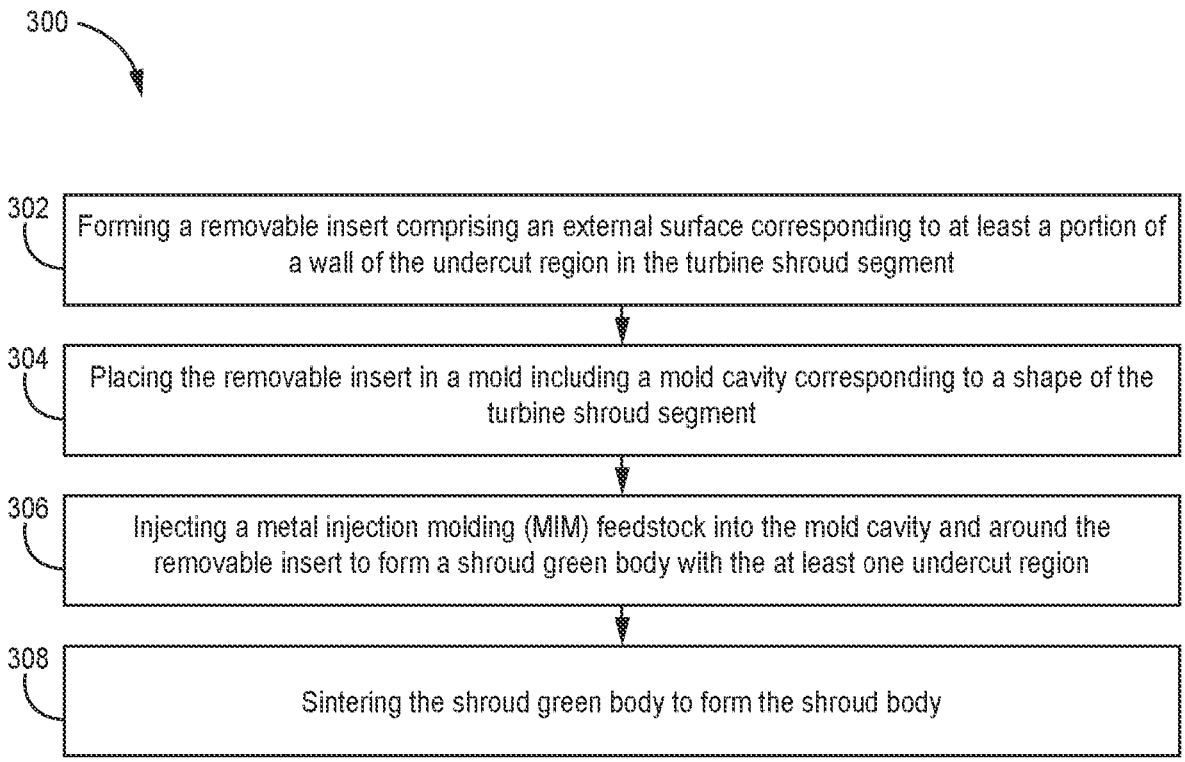
FIG. 4 is a flow chart of an embodiment of the method of the present disclosure for making a MIM part using a removable mold insert.

FIG. 4 is directed to a method 300 for manufacturing a turbine shroud body with at least one undercut region. The method includes at step 302 forming a removable insert comprising an external surface corresponding to at least a portion of a wall of the undercut region in the turbine shroud segment. In step 304, the removable insert is placed in a mold including a mold cavity corresponding to a shape of the turbine shroud segment. In step 306, a metal injection molding (MIM) feedstock is injected into the mold cavity and around the removable insert to form a shroud green body with the at least one undercut region. In step 308, the shroud green body is sintered to form the shroud body.

The above described shroud manufacturing method has several advantages including design flexibility, simplified production process, manufacturing lead-time reduction, production cost savings, no need for hazardous materials to dissolve casting ceramic cores, and the like. Polymeric materials, waxes and low melting point metals can be readily shaped and can be less fragile than ceramic materials, and have fewer design limitations in term of shape and size when compared to ceramics. More complex shroud shapes can thus be realized using MIM processes.

Various embodiments of the invention have been described. These and other embodiments are within the scope of the following claims.

The invention claimed is:

1. A method for manufacturing a turbine shroud segment with at least one undercut region, the method comprising:

forming a first removable insert comprising an external surface corresponding to at least a portion of a wall of a first undercut region of the at least one undercut region in the turbine shroud segment, wherein the first removable insert does not extend beyond the first undercut region;

forming a second removable insert comprising an external surface corresponding to at least a portion of a wall of a second undercut region of the at least one undercut region in the turbine shroud segment, wherein the second removable insert does not extend beyond the second undercut region;

placing the first removable insert and the second removable insert in a mold comprising a mold cavity corresponding to a shape of the turbine shroud segment, wherein the first removable insert and the second removable insert are retained in the mold cavity with at least one fastener, and wherein the second undercut region is opposite the first undercut region in the mold cavity;

injecting a metal injection molding (MIM) feedstock into the mold cavity and around the first removable insert and the second removable insert to form a shroud green body with the first undercut region and the second undercut region; and sintering, while the shroud green body remains in the mold, the shroud green body to form a shroud body of the turbine shroud segment, wherein the first removable insert and the second removable insert in the mold cavity are at least partially dissolved during or after the sintering step.

2. The method of claim 1, wherein the first removable insert and the second removable insert in the mold cavity are at least partially dissolved in the sintering step.

3. The method of claim 1, wherein the first removable insert and the second removable insert are at least partially dissolved prior to the sintering step.

4. The method of claim 1, wherein the first removable insert and the second removable insert are separated from the turbine shroud segment following the sintering step.

5. The method of claim 2, wherein the first removable insert and the second removable insert comprise a soluble material chosen from polymers, waxes, metal alloys, and mixtures and combinations thereof.

6. The method of claim 4, wherein the first removable insert and the second removable insert comprise a ceramic material.

7. The method of claim 4, wherein the first removable insert and the second removable insert comprise a metal.

8. The method of claim 3, comprising dissolving the first removable insert and the second removable insert by applying an acid or a base to the shroud green body.

9. The method of claim 3, comprising dissolving the first removable insert and the second removable insert by applying an aqueous solution to the shroud green body.

10. The method of claim 3, comprising dissolving the first removable insert and the second removable insert by applying an organic solvent to the shroud green body.

11. The method of claim 3, wherein the MIM feedstock comprises a base metal powder mixture; and wherein the first removable insert and the second removable insert comprise a polymeric material with a melting temperature greater than an injection temperature of the base metal powder mixture.

12. The method of claim 11, wherein the first removable insert and the second removable insert comprise a solid body of the polymeric material.

13. The method of claim 1, wherein the first removable insert is retained in the mold cavity with a first fastener of the at least one fastener and the second removable insert is retained in the mold cavity with a second fastener of the at least one fastener.

14. A method for manufacturing a turbine shroud body with at least one undercut region comprising an overhang and an arcuate wall positioned between an arcuate platform and the overhang, the method comprising:

forming a first sacrificial insert comprising a body of a soluble material chosen from polymers, waxes, and metal alloys, wherein the body of the first sacrificial insert comprises an external surface corresponding to at least a portion of a wall of a first undercut region of the at least one undercut region, wherein the first sacrificial insert does not extend beyond the first undercut region;

forming a second sacrificial insert comprising a body of a soluble material chosen from polymers, waxes, and metal alloys, wherein the body of the second sacrificial insert comprises an external surface corresponding to at least a portion of a wall of a second undercut region of the at least one undercut region, wherein the second sacrificial insert does not extend beyond the second undercut region;

placing the first sacrificial insert and the second sacrificial insert in a mold comprising a mold cavity corresponding to a shape of the turbine shroud segment, wherein the first sacrificial insert and the second sacrificial insert are retained in the mold cavity with at least one fastener;

injecting with a metal injection molding (MIM) process a base metal powder mixture into the mold cavity and around the first sacrificial insert and the second sacrificial insert to form a shroud green body with the first undercut region and the second undercut region; and sintering, while the shroud green body remains in the mold, the shroud green body to form the shroud body and at least partially dissolve the sacrificial insert, wherein the first sacrificial insert and the second sacrificial insert in the mold cavity are at least partially dissolved during or after the sintering step.

15. The method of claim 14, wherein the first sacrificial insert and the second sacrificial insert comprise a solid body of a polymeric material.

16. The method of claim 1, wherein forming the first removable insert and the second removable insert further comprises applying a layer of a lubricant or a mold release composition to an external surface of the first removable insert and an external surface of the second removable insert.

17. The method of claim 1, wherein the first removable insert and the second removable insert are formed from a material having a melting temperature that is sufficiently high to not melt at temperatures corresponding to an injection temperature of the MIM feedstock during the injecting step.

18. The method of claim 17, wherein the first removable insert and the second removable insert are formed from the material having the melting temperature that is less than a sintering temperature of the MIM feedstock during the sintering step.

* * * * *